US006172451B1

(12) United States Patent
Aoki

(10) Patent No.: US 6,172,451 B1
(45) Date of Patent: Jan. 9, 2001

(54) DEFLECTION YOKE WITH VERTICAL PINCUSHION DISTORTION

(75) Inventor: Kyosuke Aoki, Fukushima (JP)

(73) Assignee: Sony Corporation, Tokyo (JP)

( * ) Notice: Under 35 U.S.C. 154(b), the term of this patent shall be extended for 0 days.

(21) Appl. No.: 09/208,996

(22) Filed: Dec. 11, 1998

(30) Foreign Application Priority Data

Dec. 12, 1997 (JP) ..... 9-342369

(51) Int. Cl.[7] ..... H01J 29/70

(52) U.S. Cl. ..... 313/440; 313/421; 335/210; 335/213; 335/212

(58) Field of Search ..... 313/440, 412, 313/413, 441, 442, 433, 429, 426, 421, 430, 431; 335/210, 212, 213

(56) References Cited

U.S. PATENT DOCUMENTS 3,792,305 * 2/1974 Lister ..... 335/210

5,847,503 * 12/1998 Roussel et al. ..... 313/440

FOREIGN PATENT DOCUMENTS 5-252525 9/1993 (JP) ..... 29/76

* cited by examiner

*Primary Examiner*—Nimeshkumar D. Patel
*Assistant Examiner*—Joseph Williams
(74) *Attorney, Agent, or Firm*—Ronald P. Kananen; Rader, Fishman & Grauer

(57) ABSTRACT

A deflection yoke includes horizontal deflection coils; vertical deflection coils; and coils for correcting a vertical pincushion distortion, which coils are provided aside from the vertical deflection coils; wherein the coils for correcting a vertical pincushion distortion have such a wire-wound form as to generate a magnetic field having a pattern substantially equal to that of the vertical deflection coils. This is effective to carry a parabolic current with horizontal cycles for correcting a vertical pincushion distortion at a low voltage, and hence to simplify the circuit configuration and reduce the manufacturing cost.

7 Claims, 2 Drawing Sheets

DEFLECTION YOKE WITH VERTICAL PINCUSHION DISTORTION

BACKGROUND OF THE INVENTION

The present invention relates to a deflection yoke used for a color cathode-ray tube, and particularly to a deflection yoke capable of correcting a vertical pincushion distortion with a simple structure.

As for an in-line type color cathode-ray tube (CRT) with three color electron guns arranged in the transverse direction, which is one of the shadow mask type CRTs, there have been proposed various measures for correcting three electron beams in such a manner that the electron beams having passed through apertures of a shadow mask accurately land on centers of respective phosphors.

The beam landing correction has been performed by a deflection yoke system, typically, a self-convergence and pincushion free deflection yoke system.

Flattening of the screen of an inline color CRT gives rise to an inconvenience associated a vertical pincushion distortion. To cope with such an inconvenience, the related art beam landing correction method mentioned above is required to employ a number of various kinds of field control plates and magnets. This causes a problem that the image quality is degraded due to local distortion or the like and the manufacturing cost is raised.

A deflection yoke system intended to solve the above problem has been known, for example, from japanee Patent Laid-open No. Hei 5-252525. This deflection yoke system includes front field control plates arranged on the cone portion side of vertical deflection coils at positions along diagonal lines of the screen of the CRT, a front cross arm for correcting a vertical pincushion distortion of an-image, and a circuit for correcting misconvergence in the vertical direction of an image by correcting a horizontal deflection current in synchronization with a vertical deflection current.

In this deflection yoke system, the vertical deflection coils are arranged at four locations on the cone portion side.

To correct the vertical pincushion distortion, there has been also used another method in which a current, obtained by modulating a parabolic current with horizontal cycles on the basis of vertical cycles, is allowed to flow in vertical deflection coils of a deflection yoke.

As described above, a color cathode-ray tube is required to prevent a degradation in image quality due to the vertical pincushion distortion, and as one of various measures, there has been used a method of allowing a current, obtained by modulating a parabolic current with horizontal cycles on the basis of vertical cycles, to flow in vertical deflection coils.

This method is advantageous in that it can be relatively simply realized; however, since the vertical deflection coils of the deflection yoke must be driven at a low frequency, the number of turns of the vertical deflection coils becomes large, to thereby increase the impedance of the vertical deflection coils.

As a result, in the deflection yoke, a high voltage must be applied to the vertical deflection coils for allowing a specific current to flow in the vertical deflection coils. This gives rise to a problem that the circuit configuration is complicated and the manufacturing cost is raised.

SUMMARY OF THE INVENTION

An object of the present invention is to provide a deflection yoke capable of carrying a parabolic current with horizontal cycles at a low voltage, thereby simplifying the circuit configuration and reducing the manufacturing cost.

To achieve the above object, according to an aspect of the present invention, there is provided a deflection yoke including: horizontal deflection coils; vertical deflection coils; and coils for correcting a vertical pincushion distortion, which coils are provided aside from, or in addition to, the vertical deflection coils; wherein the coils for correcting a vertical pincushion distortion have such a wire-wound form as to generate a magnetic field having a pattern substantially equal to that of the vertical deflection coils.

The wire-wound location of the coils for correcting a vertical pincushion distortion may be radially closer to the deflection yoke than that of the vertical deflection coils.

The number of turns of the coils for correcting a vertical pincushion distortion may be smaller than that of the vertical deflection coils, whereby a current with horizontal cycles is allowed to easily flow in the coils for correcting a vertical pincushion distortion.

In a preferred embodiment, the vertical deflection coils have a wire-wound form of a section winding type, and a turn ratio between the vertical deflection coil and the coil for correcting a vertical pincushion distortion in each winding groove is set constant or the coefficient of the Fourier development of the winding distribution of the vertical deflection coils is the same as that of the coils for correcting a vertical pincushion distortion.

In another preferred embodiment, the vertical deflection-coils have a wire-wound form of a toroidal winding type, and a turn ratio between the vertical deflection coil and the coil for correcting a vertical pincushion distortion in each arcuate region having a specific angle θ with respect to the axial center of the deflection yoke formed into a circular shape is set constant or the coefficient of the Fourier development of the winding distribution of the vertical deflection coils is the same as that of the coils for correcting a vertical pincushion distortion.

According to the present invention having the above configurations, since the impedance of coils for correcting a vertical pincushion distortion can be made lower than that of the vertical deflection coils and thereby a parabolic current with horizontal cycles for correcting the vertical pincushion distortion can be carried at a low voltage, it is possible to simplify the circuit configuration and to reduce the manufacturing cost.

DETAILED DESCRIPTION OF THE PREFERRED EMBODIMENTS

Hereinafter, preferred embodiments will be described in detail with reference to the accompanying drawings.

As a feature of a deflection yoke according to the present invention, coils for correcting a vertical pincushion distortion are provided aside from vertical deflection coils.

Figure 1:
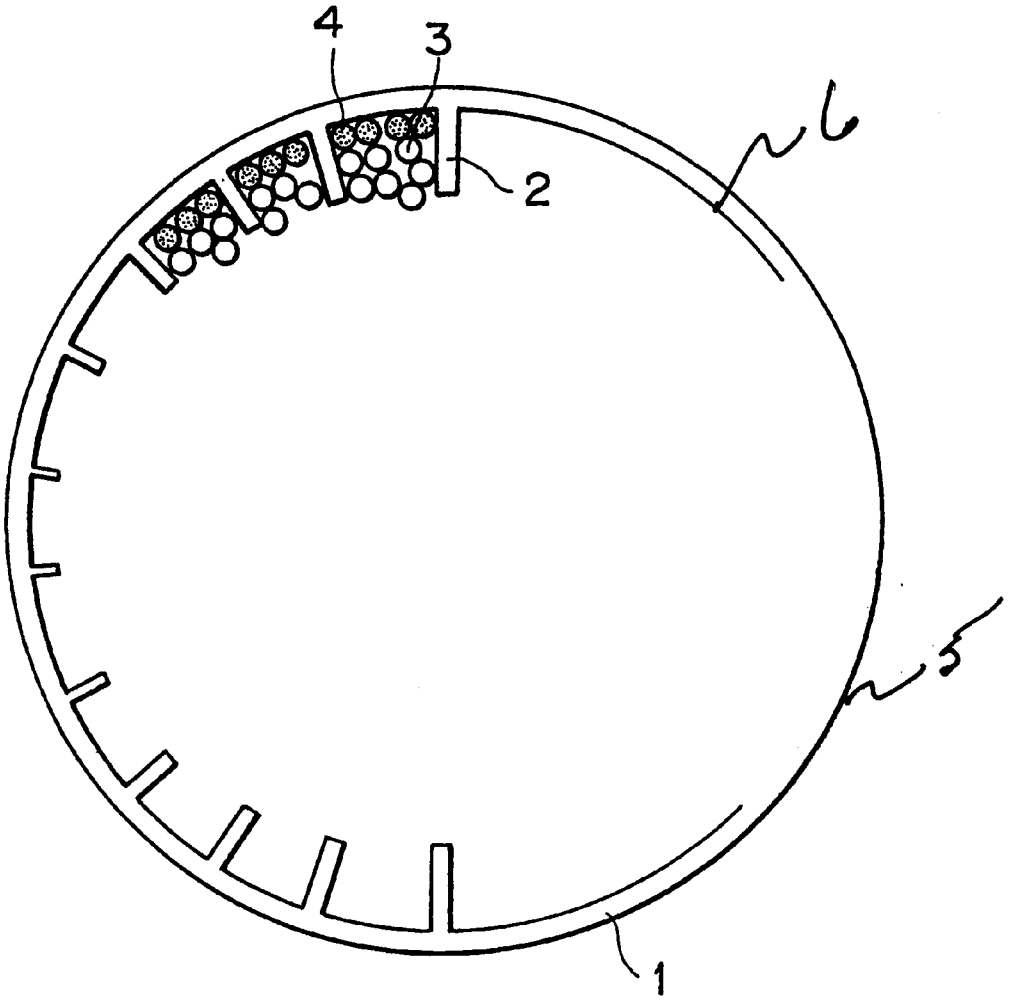
FIG. 1 is a schematic sectional view showing an essential portion of one embodiment of a deflection yoke of the present invention.

FIG. 1 is a schematic sectional view showing an essential portion of one embodiment of the deflection yoke of the present invention. In FIG. 1, reference numeral 1 designates a deflection yoke, 2 is a partition piece, 3 is a wire for a vertical deflection coil, and 4 is a wire for a correcting coil. The deflection yoke generally includes an outer circumference 5 and an inner surface 6 to which the partition pieces 2 are formed.

The vertical deflection coils shown in FIG. 1 have a wire-wound form of a section winding type.

In the section winding type, the partition pieces 2 for forming winding grooves are provided inside the deflection yoke 1.

The vertical deflection coil obtained by winding the wire 3 a specific number of turns is mounted in one winding groove formed by an adjacent pair of the partition pieces 2.

On the inner circumference 6 of the deflection yoke 1 of the present invention shown in FIG. 1, a vertical pincushion correcting coil obtained by previously winding the wire 4 is arranged before the vertical deflection coil is arranged. Thus the wire-wound location of vertical pincushion connecting coil 3 is radially closer to the inner circumference 6 of the deflection yoke 3 than that of said vertical deflection coil.

The same effect can be obtained by winding the wire 4 for the vertical pincushion distortion correcting coil after winding the wire 3 for the vertical deflection coil. In either case, the coil obtained by winding the wire has such a wire-wound form as to generate a magnetic field having a pattern substantially equal to the coil obtained by winding the wire 3.

A turn ratio between the vertical deflection coil and the vertical pincushion distortion correcting coil in each winding groove is set constant.

In addition, if the above turn ratio cannot be set constant by limitation of the number of turns (impedance), the wire 4 of the correcting coils may be positioned so that the coefficient of the Fourier development of the winding distribution of the vertical deflection coils is the same as that of the vertical pincushion distortion correcting coils.

Figure 2:
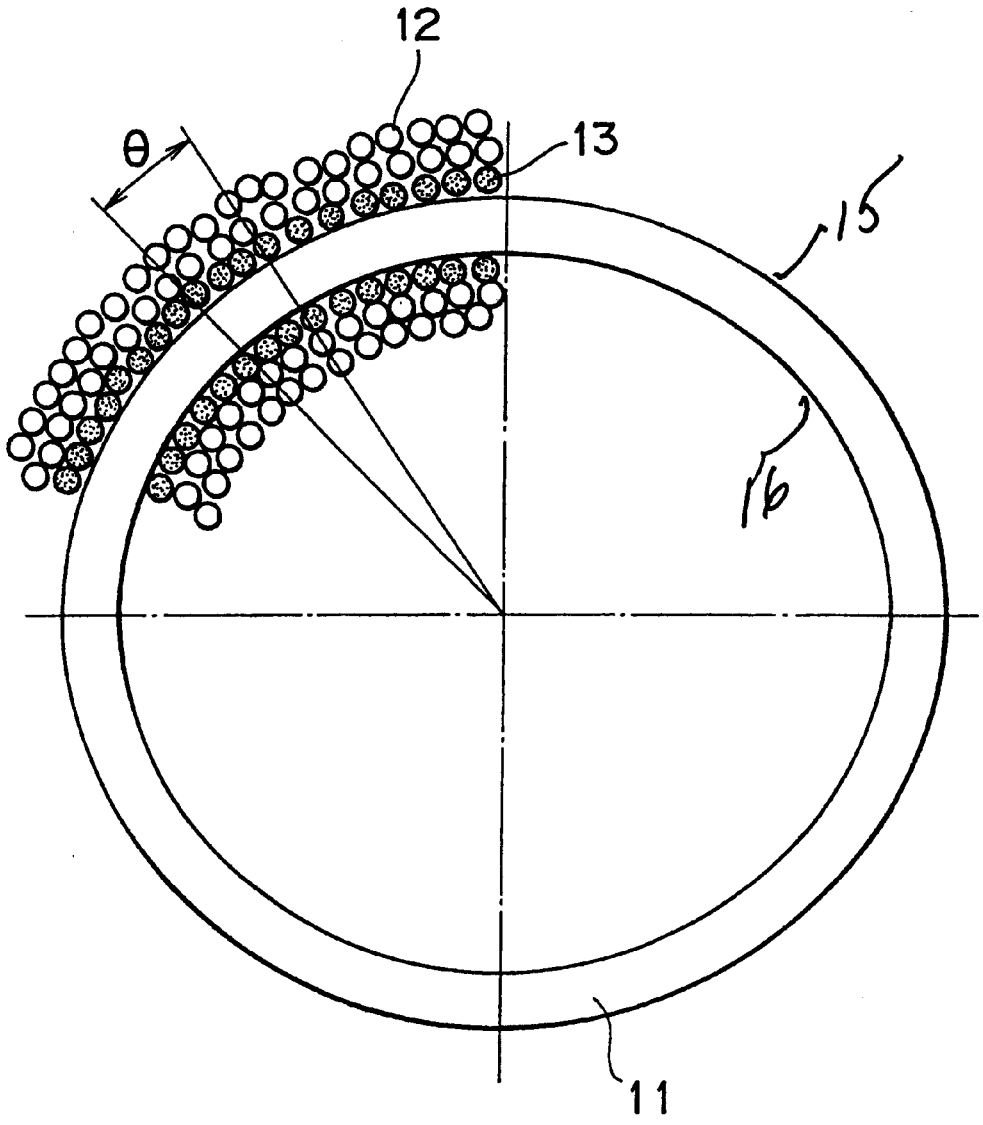
FIG. 2 is a schematic sectional view showing an essential portion of another embodiment of the deflection yoke of the present invention.

FIG. 2 is a schematic sectional view showing an essential portion of another embodiment of the deflection yoke of the present invention. In FIG. 2, reference numeral 11 designates a deflection yoke, 12 is a wire for a vertical deflection coil; and 13 is a wire for a correcting coil. The deflection yoke 11 has an outer circumference 15 and an inner circumference 16.

The vertical deflection coils shown in FIG. 2 have a wire-wound form of a toroidal winding type.

For the toroidal-winding type, each vertical deflection coil obtained by winding the wire 12 a specific number of turns is mounted to the deflection yoke 11.

On the inner circumference 16 of the deflection yoke of the present invention shown in FIG. 2, each vertical pincushion correcting coil obtained by previously winding the wire 13 is arranged before the vertical deflection coil 12 is arranged.

Even for this deflection yoke 11, the same effect can be obtained by winding the wire 13 for the vertical pincushion distortion correcting coil after winding the wire 12 for the vertical defection coil.

In the toroidal winding type, as shown in FIG. 2, a turn ratio between the vertical deflection coil and the vertical pincushion distortion correcting coil in an arcuate region having a specific angle θ with respect to the axial center of the deflection yoke 11 is set constant.

In addition, like the section winding type, if the above turn ratio cannot be set constant by limitation of the number of turns (impedance), the wire 13 for the correcting coils may be positioned so that the coefficient of the Fourier development of the winding distribution of the vertical deflection coils is the same as that of the vertical pincushion distortion correcting coils.

While the preferred embodiments have been described using specific terms, such description is for illustrative purposes only, and it is to be understood that changes and variations may be made without departing from the spirit or scope of the following claims.

What is claimed is:

1. A deflection yoke structure with horizontal deflection coils, and capable of correcting vertical pincushion distortion, said defection yoke structure comprising:

a deflection yoke having an outer circumference, an inner circumference, and a plurality of partition pieces on said inner circumference extending toward the center of said deflection yoke to define a plurality of winding grooves therebetween;

vertical deflection coils having a wire-wound form of a section winding type located in a winding groove on the inner circumference of said deflection yoke;

correcting coils in each winding groove for correcting a vertical pincushion distortion from said vertical deflection coils, which correcting coils are provided in addition to and radially adjacent to said vertical deflection coils, said correcting coils being located radially closer to said inner circumference within each section of said deflection yoke than that of said vertical deflection coils;

wherein said correcting coils for correcting a vertical pincushion distortion have such a wire-wound form as to generate a magnetic field having a pattern substantially equal to that of said vertical deflection coils.

2. A deflection yoke according to claim 1, wherein the wire-wound location of said correcting coils for correcting a vertical pincushion distortion is adjacent to said inner circumference of said deflection yoke.

3. A deflection yoke according to claim 1, wherein the number of tuns of said correcting coils for correcting a vertical pincushion distortion is smaller than that of said vertical deflection coils, whereby a current with horizontal cycles is allowed to easily flow in said correcting coils for correcting a vertical pincushion distortion.

4. A deflection yoke according to claim 1, wherein said vertical deflection coils having a wire-wound form of a section winding type, and have a turn ratio between said vertical deflection coil and said correcting coil for correction a vertical pincushion distortion in each winding groove is set constant.

5. A deflection yoke structure with horizontal deflection coils, and capable of correcting vertical pincushion distortion, said deflecting yoke structure comprising:

a deflection yoke having an outer circumference, and an inner circumference structurally adapted for receiving coils wound thereabout in a wire-wound form of a toroidal winding type;

vertical deflection coils wound about said inner and outer circumference of said deflection yoke; and correcting coils wound about said inner and outer circumference of said deflection yoke for correcting a vertical pincushion distortion, which correcting coils are adjacent to said inner circumference and said outer circumference and adjacent to said vertical deflection coils;

wherein said correcting coils for correcting a vertical pincushion distortion have such a wire-wound form as to generate a magnetic field having a pattern substantially equal to that of said vertical deflection coils;

wherein said vertical deflection coils have a wire-wound form of a toroidal winding type, and a turn ratio between said vertical deflection coil and said coil for correcting a vertical pincushion distortion in each arcuate region having a specific angle Θ with respect to the axial center of said deflection yoke formed into a circular shape is set constant.

6. A deflection yoke structure according to claim 1, wherein the coefficient of the Fourier development of the winding distribution of said vertical defection coils is the same as that of said correcting coils for correcting a vertical pincushion distortion.

7. A deflection yoke structure according to claim 5, wherein the coefficient of the Fourier development of the winding distribution of said vertical deflection coils is the same as that of said correction coils for correcting a vertical pincushion distortion.

* * * * *